United States Patent [19]

Bernhard

[11] 4,054,381

[45] Oct. 18, 1977

[54] TONER FILTER ARRANGEMENT

[75] Inventor: John S. Bernhard, Webster, N.Y.

[73] Assignee: Xerox Corporation, Stamford, Conn.

[21] Appl. No.: 673,763

[22] Filed: Apr. 5, 1976

[51] Int. Cl.[2] ..... G03G 21/00

[52] U.S. Cl. ..... 355/15; 209/300; 355/3 DD

[58] Field of Search ..... 355/3 R, 3 DD, 15; 15/1.5; 209/300, 390

[56] References Cited

U.S. PATENT DOCUMENTS

| | | | |
|---|---|---|---|
| 3,655,375 | 4/1972 | Madrid | 355/15 X |
| 3,963,608 | 6/1976 | Zimmermann et al. | 209/300 |

*Primary Examiner*—Richard L. Moses

[57] ABSTRACT

A toner filter arrangement adapted for use in a cleaning station of a xerographic reproduction machine whereby foreign matter and other contaminants are removed from residual toner prior to its collection in a disposable or re-use container or return to the developer station. The filter arrangement comprises a housing having an input opening through which removed toner enters and an output opening through which filtered toner exits by gravity fed. The housing includes a spiral brush mounted for rotation on a shaft centrally located within the housing and a stationary open mesh screen coaxially located with respect to the shaft. Rotation of the brush operates to sift toner through the screen to the outlet of the filter housing.

6 Claims, 3 Drawing Figures

TONER FILTER ARRANGEMENT

BACKGROUND OF THE INVENTION

This invention relates to an arrangement for automatically filtering contaminants and foreign materials from electroscopic developer material used in electrostatic copiers.

In the art of xerography, a xerographic plate, which is formed of a conductive backing upon which is placed a photoconductive insulating material is charged uniformly in the surface of the plate and subsequently exposed to a light image of the original to be reproduced. The photoconductive coating is thereby caused to become conductive under the influence of the light image so as to selectively dissipate the electrostatic charge found thereon thus producing an electrostatic latent image. The latent image is made visible by developing it with any one of a variety of pigmented resins which have been specifically developed for this purpose. In the xerographic process, the pigmented resin material, or toner, is electrostatically attracted to the latent image on the photoconductive surface in proportion to the amount of charge found thereon. Areas of small concentration become areas of low toner density while areas of greater charge concentration become proportionally more dense. The fully developed image is then transferred from the plate surface to the final support material, as for example, paper, is fixed thereto to form a permanent record of the original copy.

A preponderance of the toner material is transferred from the photoconductive surface to the final support material during the transfer operation. However, it has been found that forces bonding some of the toner particles to the photoconductive surface are stronger than the transfer forces involved and, therefore, some particulate material remains on the photoconductive surface after the xerographic image is transferred. This residual toner, if not cleaned from the xerographic plate in some manner, will have a deleterious effect on subsequent images processed on the plate.

Plate cleaning in automatic xerographic machines in which the plate is continually reused in the xerographic process is accomplished by various devices such as fiber brushes, cleaning webs, wiper blades or the like. The toner material so removed may be collected and stored in the machine and then periodically removed and discarded. Alternatively, collected toner may be returned from the cleaning station of the machine to the development housing for reuse in the development process. This returning of toner may be done manually by first collecting the cleaner toner in a container at the cleaning station and later dumping the contents of this container into the developer sump.

A system for automatically recovering residual toner and returning it to the developer housing for reuse in the development zone is described in U.S. Pat. No. 3,752,576 and U.S. Pat. No. 3,678,896 in which an endless bead chain conveyor moves between the cleaning station and the development station of a xerographic system. As provided in the cleaning systems shown in the above-noted patents, toner cleaned from the xerographic plate at the cleaning station is moved from the cleaning station to the developer station by means of a bead chain conveyor and deposited into the sump of the development unit for reuse in the development process.

It has been found that toner returned to the development unit in such systems often contains contaminants and foreign matter such as fibers, brush fibers, metal chips, and pieces of foam which if not removed are automatically transported back to the developer housing by the above noted bead chain system. Such foreign particles often jam up the bead chain system thus necessitating cleaning or replacement of the unit in the field. If the particles pass through the bead chain conveyor system, they are returned to the developer housing and may have an adverse effect on the quality of the development system. As developer life increases, the percentage of foreign particles being constantly recirculated within the machine in the above-noted manner gradually increases and the deleterious effects thereof become more aggravated. The only removal of contaminants under the present system occurs when either the developer is changed or the toner return system is removed and cleaned or replaced.

OBJECTS AND SUMMARY OF THE INVENTION

It is therefore an object of this invention to improve xerography, and in particular automatic xerographic reproducing apparatus.

A further object of this invention is to automatically filter contaminants and foreign materials from reclaimed toner removed at the cleaning station of a xerographic machine prior to its advance back to the developer housing. A more general object is the provision of a filter assembly for removing foreign matter from toner.

These and other objects are accomplished by means of a filter arrangement including a cylindrical housing and a brush mounted for rotation within the housing. A stationary cylindrical wire screen or mesh is supported within the housing surrounding the brush and spaced a small distance from both the housing and the brush. The brush, mesh and housing may be arranged generally coaxially with respect to each other. The openings in the screen are selected to pass toner particles but to obstruct the passage of particles larger than toner. Rotation of the brush creates a shifting action and toner is forced through the screen and drops by gravity into a toner drop tube. Particles larger than the openings in the screen remain inside the screen and thus are not returned for reuse in the developer system in either of the manners described hereinbefore.

For a better understanding of the invention as well as other objects and further features thereof, reference is had to the following detailed description of the invention to be read in connection with the accompanying drawings.

DESCRIPTION OF THE PREFERRED EMBODIMENTS

Figure 1:
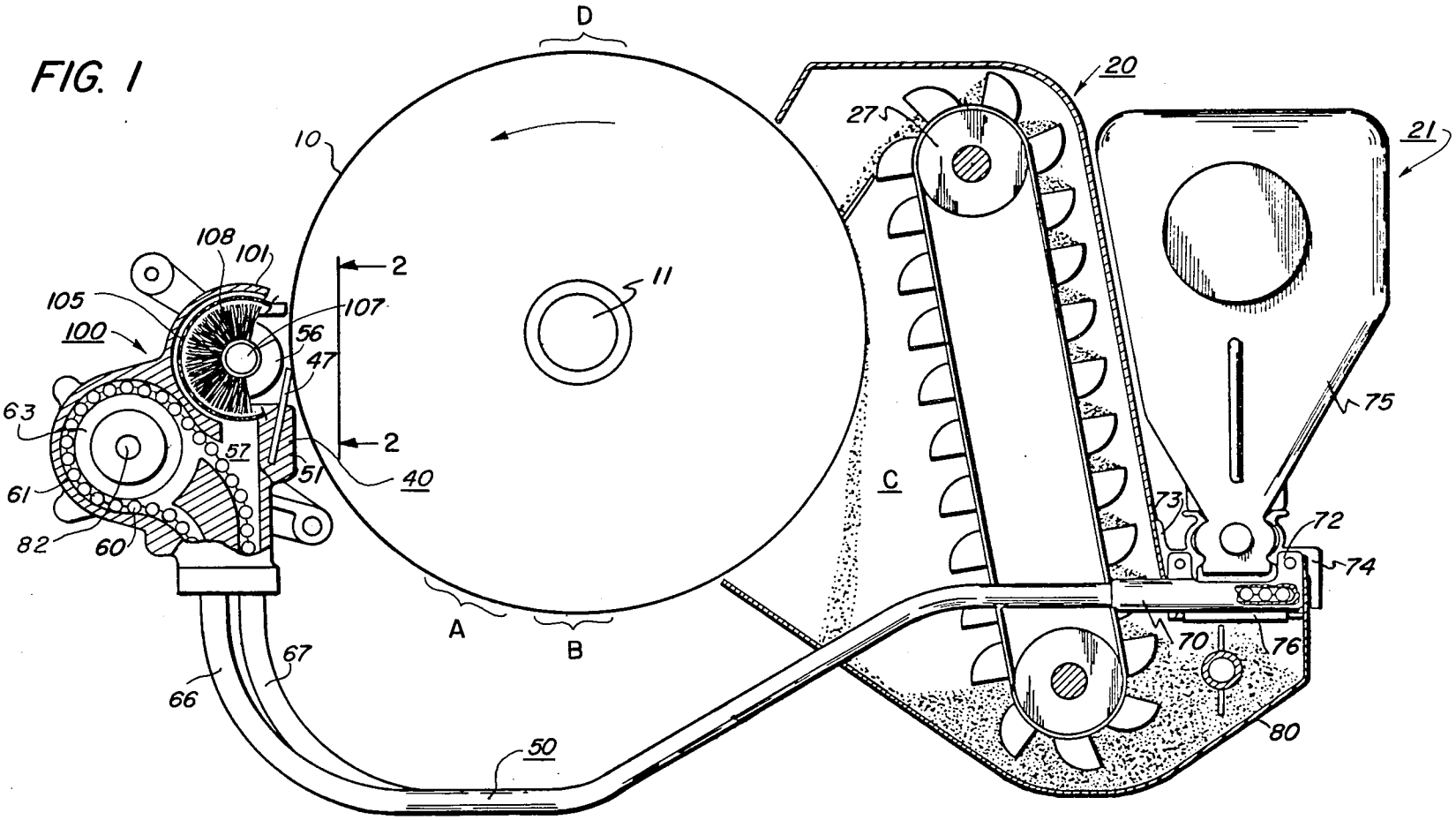
FIG. 1 shows pertinent portions of an automatic xerographic reproducing apparatus with a prior art cleaning system modified to incorporate the filtering arrangement of the present invention.

Referring to the drawings, the invention is shown in FIG. 1 as part of a well known xerographic copy machine comprising a xerographic plate including a photoconductive layer of a light receiving surface on a conductive backing and formed in the shape of a drum, generally numerically designated 10 which is journaled in the frame of the machine by means of shaft 11. The xerographic plate is rotated in the direction indicated in FIG. 1 to cause the drum surface to pass sequentially through a plurality of xerographic processing stations.

For the purpose of the present disclosure the several xerographic processing stations in the path of movement of the drum surface may be described functionally as follows:

A charging station A, in which a uniform electrostatic charge is deposited on the photoconductive layer of the xerographic drum;

An exposure station B wherein a light or radiation pattern of an original document to be reproduced is projected onto the drum surface to dissipate the charge found thereon in the exposed areas to form a latent electrostatic image;

A development station C, at which a xerographic developing material having toner particles possessing an electrostatic charge opposite to the charge found on the drum surface in the latent images are cascaded over the moving drum surface whereby the toner particles adhere to the electrostatic latent image to make visible the image in the configuration of the original document to be reproduced;

A transfer station D, in which the xerographic powder image is electrostatically transferred from the drum surface to a final support material; and A drum cleaning and toner collecting station E, wherein the drum surface is first charged and then wiped with a doctor blade to remove residual toner particles remaining thereon after image transfer and wherein the removed toner is collected for reuse in the xerographic process and in which the drum surface is exposed to an incadescent panel to effect substantially complete discharge of any residual electrostatic charge remaining thereon.

Detailed descriptions of the operation and construction of the various processing stations is well known in the art, as exemplified by U. S. Pat. Nos. 3,678,896 and 3,752,576. For this reason, only a description of those portions of the system pertinent to the invention will be presented in more detail.

The invention is incorporated into the cleaning station of the type shown in FIG. 1 which operates to remove substantially all residual toner particles remaining on the xerographic drum surface after image transfer and recovers the residual toner as removed for reuse in the automatic reproducing apparatus in a manner to be described below. The cleaning station comprises a rectangular shaped flexible blade 47 to remove residual toner from the moving drum surface. The blade is mounted in blade holder 51 forming one wall of cleaning and collection apparatus 40 (FIG. 1). The blade normally rests transversely in pressure contact with the photoconductive layer on the drum surface. The blade is positioned so that the contacting edge cuts or chissels toner material from the drum surface.

Because of the blade's novel cleaning action, the toner particles are cut cleanly from the plate surface and are allowed to fall freely into the collecting trough provided. As a result, the toner particles substantially retain their initial integrity throughout the cleaning process and are therefore in a condition to be immediately reused in the xerographic process without recourse to further treatment or processing thereof. Suitable materials out of which the blade may be constructed are described in the aforementioned patents.

By positioning the doctor blade 47 slightly below the horizontal center line of the drum surface and providing the blade with a slight back rack, the removed residual toner material is forced to fall to the backside of the blade, that is, to the side away from the photoconductive drum surface and into an open sided channel 53, FIG. 2, adjacent to and running longitudinally along the drum surface. A screw type conveyor 55 comprising a shaft 54 which carries a spiral thread 56 is supported for rotation in the channel 53 in substantially parallel relation to the doctor blade. The open sided channel 53 is closed at one end (not shown) while the opposite end of the channel communicated with a toner filter arrangement 100, FIG. 2 according to the invention. The conveyor 55 and the channel 53 cooperate to convey the toner particles removed from the drum surface towards and into the toner filter arrangement 100.

The filter arrangement 100 includes a housing 101 generally cylindrical in shape and having an opening 102 near the bottom thereof which communicates with a toner return tube 103. The tube 103 operates to direct reclaimed toner exiting the housing 101 onto the bead chain conveyor 60 for return to the developer housing, as will be described in greater detail hereinafter.

Figure 2:
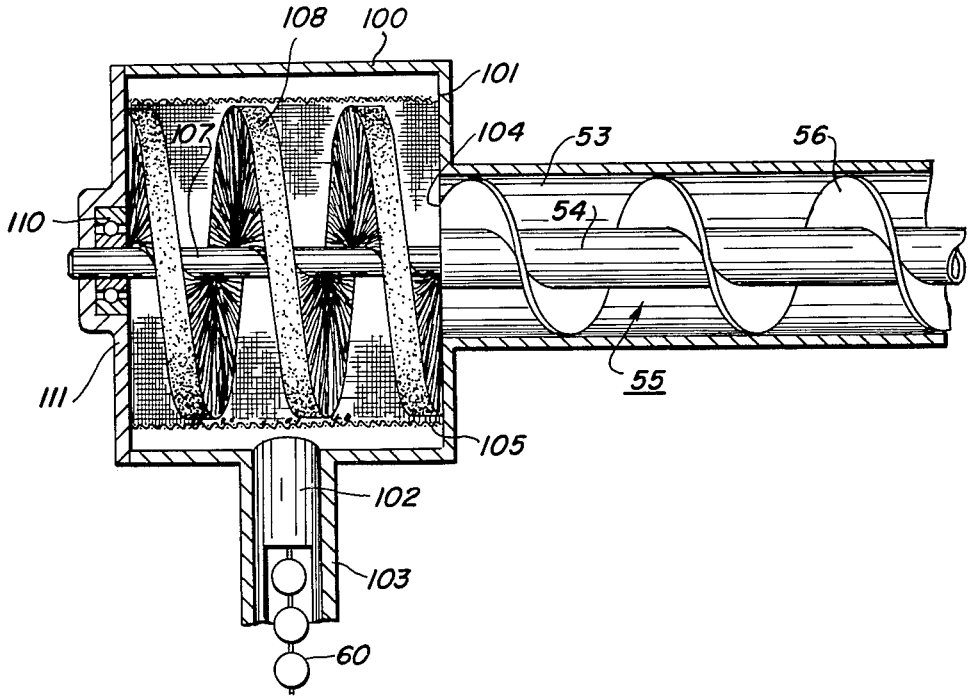
FIG. 2 is a side elevation in partial section taken in the lines 2—2 of FIG. 1 showing the details of the filter arrangement with the photoreceptor surface and cleaning blade omitted for the sake of clarity.

Another opening 104 is provided in the housing 101 which communicates with the open sided channel 53, FIG. 2. The shaft 54 is provided with an extension 107 which passes centrally through the housing 101 and is supported for rotation in a suitable bearing 110 in the end plate 111 of the housing 101 opposite the conveyor 55. The extension 107 has wound thereon a stiff fibered brush 108 in the form of a helix or spiral. A cylindrical open mesh or wire screen 105 is supported coaxially with respect to the housing 101 and brush 108 spaced from both the housing 101 and outer bristles of the brush 108.

The brush 108 may be made of any one of a variety of materials and a commercially available polypropylene brush was found to perform satisfactorily. Brushes having a relatively stiff fiber (high denier) and a low fiber density were found to perform more efficiently. High fiber density is to be avoided since it results in a large percentage of foreign matter and toner becoming lodged in the spaces between the brush fibers. In addition, the high density materials create a fine powder cloud in operation which may pose a problem if allowed to circulate inside the machine. Low density material has the advantage of causing the toner particles to be forced through the screen with a pulsating sifting action and with a sufficient initial velocity so as not to block the drop tube 103.

A 20 mesh wire screen (0.030 inch square openings) was found to be the minimum sized screen for obtaining satisfactory operation although the exact size of the screen depends in part on the characteristics of the toner material used in the xerographic process and the velocity required by the toner particles to adequately propel them onto the bead chain 60. The mesh 105 may be supported in grooves in opposite end walls of the housing 101. Spacing the mesh 105 from the brush prevents fraying and breaking of the brush fibers which further contaminate the reclaimed toner. A clearance of approximately one sixteenth of an inch between the fiber tips and the screen has been found to operate satisfactorily.

In order to permit cleaning of the screen 105 the end plate 111 includes snap type fasteners of any suitable (not shown) shape to permit easily coupling and uncoupling thereof to the housing 101. Removal of the end plate in this manner provide access to the screen 105 and brush 108 which may be periodically cleaned.

In operation, toner material removed at the cleaning station is collected in channel 53 and moved by the conveyor 55 toward the filter housing 101. The reclaimed toner is deposited by the conveyor 55 to the interior of the screen 105 and initially collects by gravity at the bottom of the screen adjacent the inlet opening. Continuous rotation of the spiral brush 108 has the effect of distributing the collected toner along the entire lowermost surface of the screen. Rotation of the brush causes a sifting action whereby toner is forced through the screen and drops by gravity via the tube 103 into a reservoir 57 above the bead chain 60. Since the openings in the screen are selected to be slightly larger than the toner particles they pass readily therethrough while foreign matter which is larger in size than toner, collects on the inside lowermost surface of the screen to be later removed.

The bead chain conveyor is described in detail in the aforementioned patents and only a brief description of its operation will be presented. A bead chain drive sprocket 63 is rotatably mounted on shaft 82 which is journaled for rotation in a drive housing 61. The drive sprocket 63 is driven directly from the main machine drive through screw conveyor shaft (not shown). Passing over the rim of the drive sprocket 63 is an endless bead chain 60. The drive sprocket is arranged to engage and guide the bead and like members of the chain to move the chain in the direction indicated.

In the present invention, the residual toner which passes through the filter housing 101 is directed onto the chain 60 and is transported back to the developer housing 80, FIG. 1, by means of a conveyor system made up of supply and return tubing 66, 67; developer housing connector 70; and toner metering and return loop 72. The various parts making up the conveyor system are mated together so that a continuous substantially closed circuit conduit 50 having a uniform inside diameter runs from reservoir area 57 across the width of the developer housing and returns once again to said reservoir.

Figure 3:
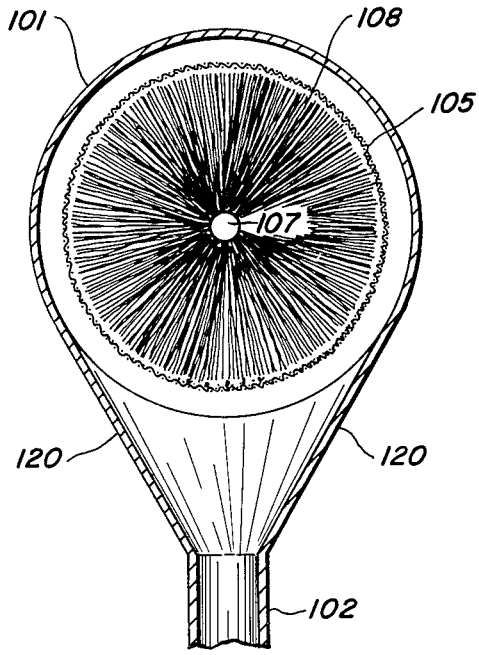
FIG. 3 shows an alternative embodiment of the invention.

An alternative embodiment of the filter housing 101 is shown in FIG. 3 which increases the effective area of the screen 105 involved in the filtering operation. As seen in FIG. 3, the housing 101 has been re-shaped to be semi-cylindrical in shape. More specifically, the lowermost quarter of the housing has been formed into a hopper having side walls 120 converting to direct toner flowing from a larger surface area of the screen 105 into the return tube 103.

This arrangement eliminates the packing of toner in areas of the housing running along the length of the filter housing but displaced to each side of the drop tube opening 102. The design in FIG. 3 permits the toner to slide more easily by gravity into the drop tube by increasing the angle between the lips of the housing adjacent the drop tube and the vertical.

While the invention has been described with reference to its preferred embodiments, it will be understood by those skilled in the art that various changes may be made and equivalents substituted for elements thereof without departing from the spirit and scope of the invention.

What is claimed is

1. An electrophotographic reproduction machine comprising a cleaning station for removing residual toner particles remaining on an imaging surface after completion of a copy cycle, a toner filter including a housing having a first opening through which said residual toner enters from said cleaning station, a helically wound fiber brush mounted for rotation in said housing, an open mesh screen supported intermediate said housing and said brush, the interior of said screen being in communication with said first opening, a second opening in said housing located to gravity feed toner exiting said housing, whereby rotation of said brush causes toner to sift through the openings in said screen and fall by gravity through said second opening.

2. The combination recited in claim 1 wherein said cleaning station comprises a screw-like conveyor including a rotatable conveyor shaft for moving toner through said first opening.

3. The combination recited in claim 2 wherein said brush is mounted on a brush shaft extending from said conveyor shaft.

4. The combination recited in claim 3 wherein said brush is carried on said brush shaft.

5. The combination recited in claim 1 wherein said housing, brush and screen are generally cylindrical in shape and supported coaxially with respect to each other.

6. The combination recited in claim 5 wherein said screen is spaced from said housing and brush.

* * * * *